US005373308A

United States Patent [19]

Kurisu et al.

[11] Patent Number: 5,373,308

[45] Date of Patent: Dec. 13, 1994

[54] COLOR BARGRAPH DISPLAY CONTROL FOR USE WITH A CATHODE RAY TUBE

[75] Inventors: Motohiro Kurisu, Kanagawa, Japan; Gary Pacey, San Jose, Calif.

[73] Assignee: Zilog, Inc., Campbell, Calif.

[21] Appl. No.: 76,270

[22] Filed: Jun. 11, 1993

Related U.S. Application Data

[63] Continuation of Ser. No. 837,590, Feb. 18, 1992, abandoned, which is a continuation of Ser. No. 431,612, Nov. 3, 1989, abandoned.

[51] Int. Cl.[5] ..... G09G 1/06

[52] U.S. Cl. ..... 345/35; 345/150

[58] Field of Search ..... 340/722, 753, 754, 701, 340/703; 364/426, 427, 428, 433, 435; 358/194.1, 194.4, 139, 10; 345/35, 36, 37, 38, 88, 72, 150; 348/734

[56] References Cited

U.S. PATENT DOCUMENTS

| | | | |
|---|---|---|---|
| 3,375,509 | 3/1968 | Mullarkey | 340/722 |
| 3,531,795 | 9/1970 | Gassler | 340/722 |
| 3,678,498 | 7/1972 | Nagamatsu et al. | 340/722 |
| 4,232,311 | 11/1980 | Agneta | 340/703 |
| 4,272,767 | 6/1981 | Lacy | 340/722 |
| 4,484,187 | 11/1984 | Brown et al. | 340/721 |
| 4,668,465 | 5/1987 | Boomgaard et al. | 324/207.15 |
| 4,847,785 | 7/1989 | Stephen | 340/722 |

FOREIGN PATENT DOCUMENTS

| | | | |
|---|---|---|---|
| 0107109 | 6/1985 | Japan | 340/722 |

*Primary Examiner*—Alvin E. Oberley
*Assistant Examiner*—Chanh Nguyen
*Attorney, Agent, or Firm*—Majestic, Parsons, Siebert & Hsue

[57] ABSTRACT

A method and apparatus for displaying a bar image in two colors on a screen of a cathode ray tube are disclosed. The device includes a first memory for storing the information to be displayed, including the first color, and a second memory for storing the screen addresses where the images are to be displayed in a second color. It also includes a microprocessor for selecting information from the first memory to be displayed at specific addresses on the screen. When the address for display is the same as one stored in the second memory, the microprocessor causes information to be displayed in the second color instead of the first color.

4 Claims, 3 Drawing Sheets

COLOR BARGRAPH DISPLAY CONTROL FOR USE WITH A CATHODE RAY TUBE

This is a continuation of application Ser. No. 837,590, filed Feb. 18, 1992, now abandoned which is continuation of application Ser. No. 07/431,612, filed Nov. 3, 1984, now abandoned.

BACKGROUND OF THE INVENTION

This invention relates in general to display controllers, and more specifically to a device for displaying color images on a screen of a cathode ray tube (CRT).

A particular application of this invention is the display of a bar indicator on a screen in two colors. A bar indicator, also known as a bar graph, is useful for graphical depiction of changing values of a continuous function.

Conventional bar graph displays have been limited in several respects. One type of bar graph uses only one color, where the bar is displayed in this one color against only an indistinct background, making it difficult for the viewer to distinguish clearly the current value of the function relative to its maximum value. A second type of bar graph uses more than one color, but the character information to be displayed is stored with its own color attribute, requiring additional memory. These and other disadvantages of the prior art are overcome by the present invention.

SUMMARY OF THE INVENTION

The device of this invention controls a cathode ray tube (CRT) in order to display color images on the screen of the tube. Locations on the screen are identified by addresses. The device includes a first storing means, a second storing means and a selecting means. The first storing means stores information to be displayed on the screen, including images to be displayed in a first color. The second storing means stores a second color and one or more addresses for indicating where the images are to be displayed in a second color. The selecting means selects information from the first storage means to be displayed at locations on the screen indicated by addresses. When one address indicating locations at which images are to be displayed is the same as one stored in the second storing means, the selecting means causes images to be displayed in the second color instead of the first color at such locations.

This invention is particularly useful for providing a bar indicator display system that can be programmed for display at any location on the screen and for color change at any point along the bar. As part of an on-screen display controller, it can be used to display volume, contrast and other continuous functions.

BRIEF DESCRIPTION OF THE DRAWINGS

FIG. 1(*a*) shows a bar display. FIG. 1(*b*) shows a location on the screen identified by a vertical and a horizontal. address.

DETAILED DESCRIPTION OF THE INVENTION

Figure 1B:
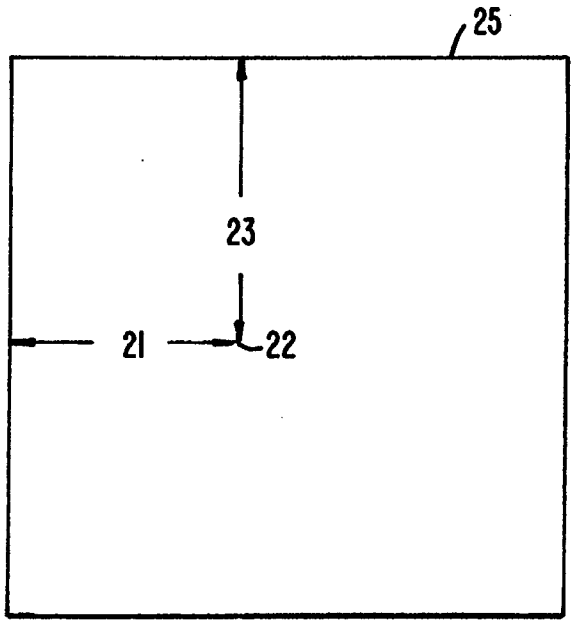
FIGS. 1(*a*) and 1(*b*) show a CRT screen.
Figure 1A:
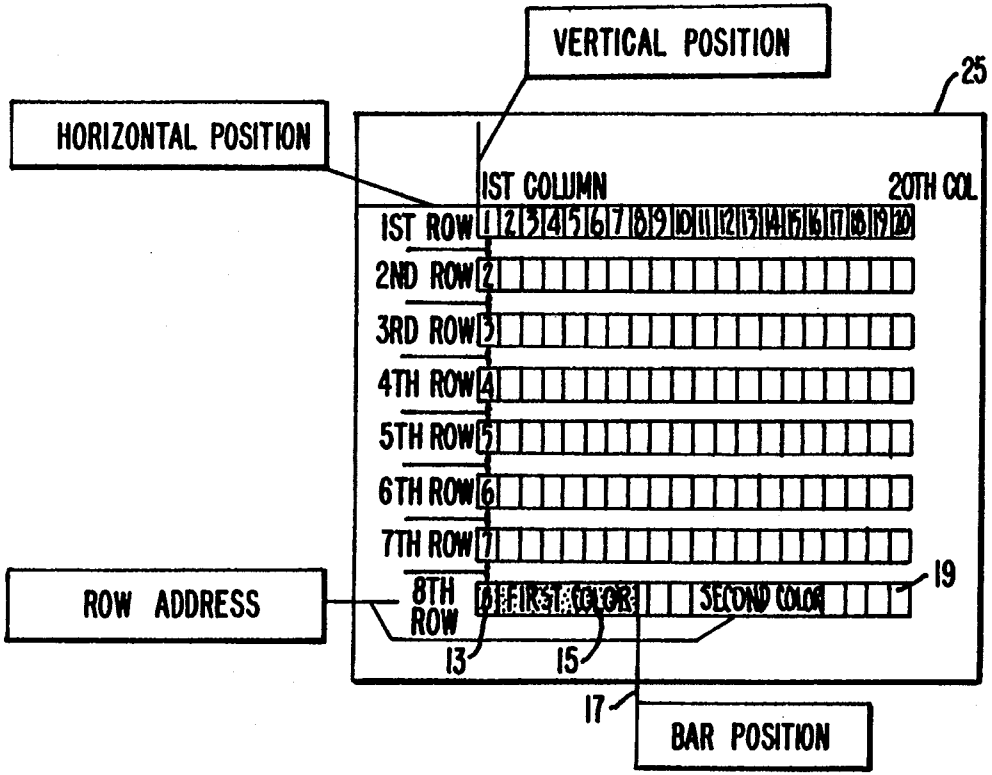

FIG. 1(*a*) shows a bar indicator 13 displayed at the eighth vertical position (or row) on a CRT screen 25. The first portion of the bar 15 to the left of a given column position 17 is displayed in one color, and the second portion of the bar 19 to the right of the given column position 17 is displayed in a second color. FIG. 1(*b*) shows a location on the screen 25 having a vertical (row) address 23 and a horizontal (column) address 21.

Figure 2:
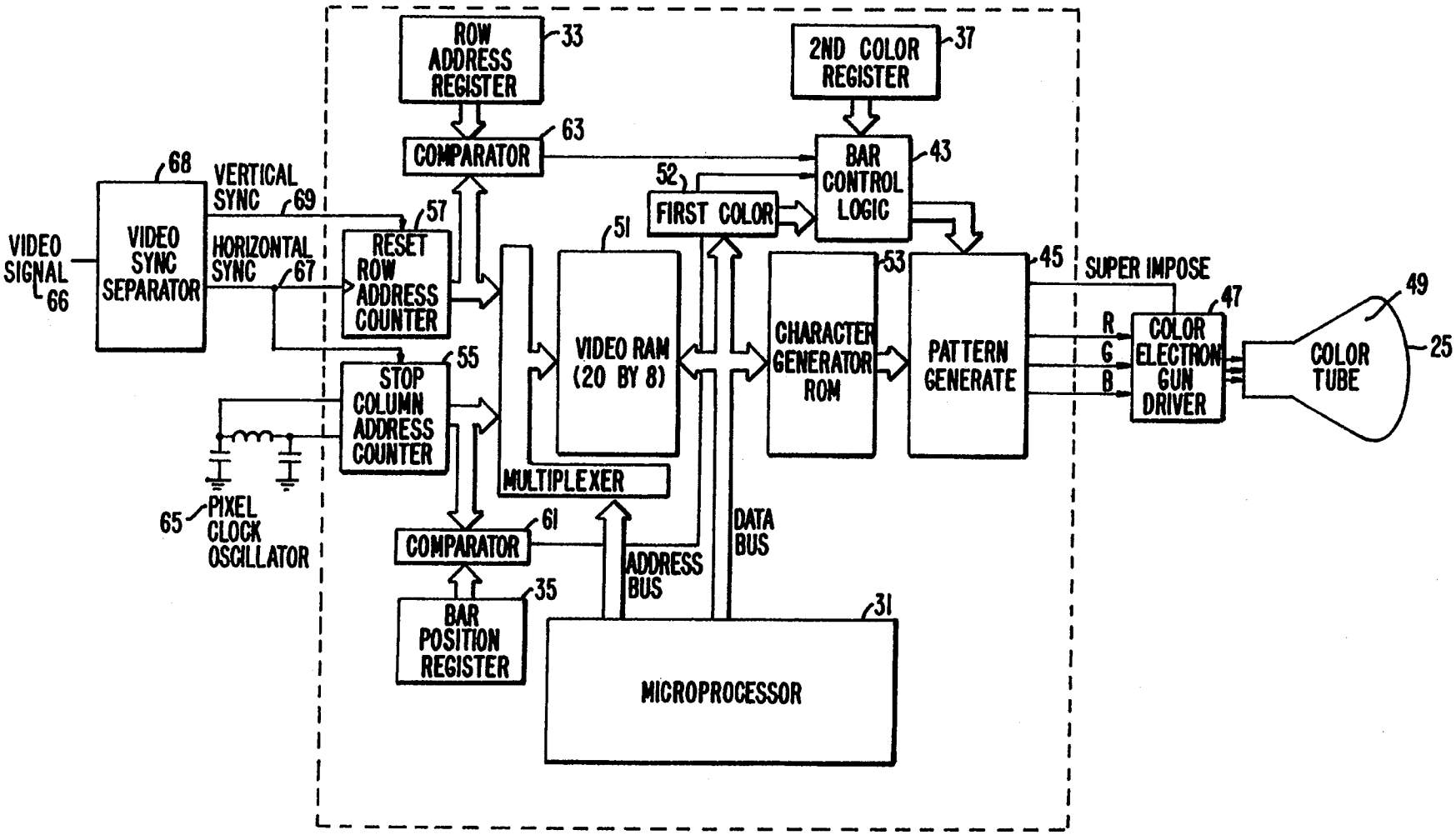
FIG. 2 is a block diagram of one embodiment of the invention. In this embodiment, a bar indicator may be displayed at any one of eight rows and any sequence of characters may be displayed in the bar.

The bar display is produced by the device shown in the block diagram of FIG. 2. HSYNC 67 and VSYNC 69 signals are separated from the incoming video signal 66 by the video sync separator 68. Each VSYNC pulse 69 resets the row address counter 57. Each HSYNC pulse 67 increments the row address counter 57 and resets the column address counter 55, which is incremented by the pixel clock 65.

The row address counter 57 and the column address counter 55 store the row and column addresses of the screen location currently being displayed. When the count in the row address counter 57 is equal to the number stored in the row address register 33 and the bar control logic 43 is active, the microprocessor 31 fetches stored information for displaying a bar graph 15 from video RAM 51 with which it indexes character patterns in ROM 53.

The pattern generator 45 combines character patterns from ROM 53 with first color information selected by the bar control logic 43 to generate RGB output for the color electron gun driver 47, causing the bar 13 (FIG. 1(*a*)) to be displayed at the designated row on the screen 25 of the color tube 49. The bar color change occurs when the count in the column address counter 55 is equal to the number stored in the bar position register 35, at which time the bar control logic 43 selects the second color 37 for display of all character data after the current column location.

Bar graph information, including characters and a first color in which characters are to be displayed, is stored in videoRAM51, which is organized as eight row arrays (21 by 7 bits each). The first location of each row array contains the attributes for that row, including programmable first character color, row background color and row background color on/off control. The next twenty bytes contain row character data, each byte indexing one of 128 displayable character patterns in character generator ROM 53. The ROM 53 can be customized for almost any language, with characters defined in either high or low resolution format.

The information necessary to cause the bar color change is stored in a number of components. These include the row address register 33 for storing the vertical address, the bar position register 35 for storing the horizontal address and the second color register 37 for storing the second color 39. As discussed in greater detail below, addresses stored in the row address register and the bar position register are used by the microprocessor 31 to select the location 17 (FIG. 1(*a*)) to begin display of character data stored in video RAM 51 in the second color 39. The first color is fetched by microprocessor 31 from RAM 51 and stored in register 52. The bar control logic 43 selects a color from either register 52 or from the second color register 37, causing the character data originally stored in video RAM 51 to be displayed in the selected color at the selected location. The timing logic is such that the second color may be displayed with full or half-character resolution.

The address selection logic for bar display includes the microprocessor 31, two address counters 55, 57 and two comparators 61, 63 for comparing the address counters to the address registers 33, 35. The address counters 55, 57 indicate the screen location being displayed, i.e. the column address 21 and the row address 23 on the screen 25 currently targeted by the electron gun driver 47. When the electron gun is addressing the upper left hand corner of the screen 25 at the beginning of a frame, both counters 55, 57 are zero. The row address counter 57 is incremented on each HSYNC pulse 67 so that it indicates the row currently being displayed. When the count of the row address counter 57 equals the number stored in the row address register 33, the output of the comparator 63 is "1.". If the bar enable bit 41 is also "1," the bar control logic 43 causes a bar indicator to be displayed at the current. row. If the bar enable bit 41 is "0," no bar indicator is displayed.

The selection of the column address for second color display occurs while the count of the row address counter 57 equals the contents of the row address register 33. The column address counter 55 is reset by each HSYNC pulse 67, and incremented by a pixel clock oscillator 65 to indicate the current column location (the size control is not shown). When the count of the counter 55 indicates the same column location as the address in the bar position register 35, the output of the comparator 61 is "1." Since the bar enable bit 41 is also "1" at this time, the bar control logic 43 causes all character data from the current column location to the end of the row to be displayed in the second color 39. In this embodiment, the size contrcl is designed by well-known design techniques to allow bar color change at any half-character position or any specified position in the row. This feature enables the viewer to see the current value of the function relative to its maxiumum value.

Figure 3:
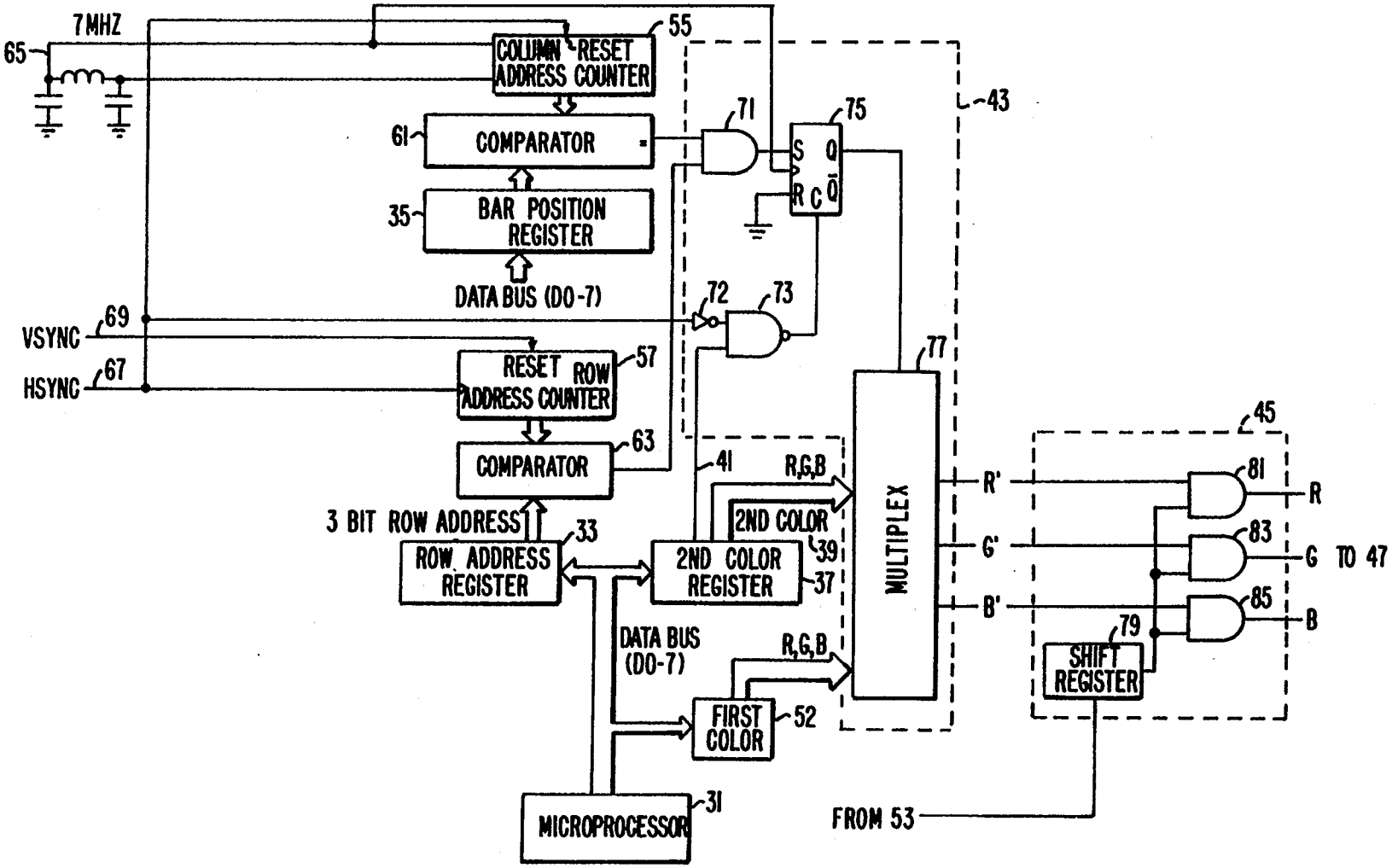
FIG. 3 is a circuit diagram showing in more detail the bar control logic of the controller system of FIG. 2.

In the embodiment shown in FIG. 3, the bar control logic 43 comprises an S-R flip flop 75 having an S input from an AND gate 71, a grounded R input, a clearing signal from the NAND gate 73, and generating an output to a multiplexor 77. The outputs of the comparators 61, 63 are inputs to the AND gate 71, such that the output of the AND gate is "1" only when both inputs are "1," i.e. only when the count in the column address counter 55 equals the number stored in the bar position register 35 and the count in the row address counter 57 equals the number stored in the row address register 33. The NAND gate 73 has two inputs, the bar enable bit 41 and the HSYNC pulse inverted by the invertor 72. The NAND gate generates a clearing pulse "1" to the S-R flip flop 75 when either or both inputs are "0." When both inputs are "1," the NAND gate output is "0," enabling the S-R flip flop to store the output of the AND gate 71 when the flip flop is activated by the pixel clock pulse.

At this time, if the AND gate 71 output is "0," the S-R flip flop outputs a "0" to the multiplexor 77 which selects the first color 52 for display of the bar indicator at the current row and column address. If the AND gate is "1," the S-R flip flop outputs a "1" to the multiplexor 77, which selects the second color 39 for display from the current column location to the end of the row. The multiplexor outputs the selected three-bit color code R'G'B' to the pattern generator 45.

The pattern generator 45 receives either the first or second color code output from the multiplexor 77 and character patterns from character generator ROM 53. The six-bit character patterns are loaded into the shift register 79. The contents of the shift register 79 are combined with the multiplexor color code by the AND gates 81, 83, 85 to generate RGB signals to the electron gun driver 47. In this way, the bar indicator is displayed in the desired color.

This invention is advantageous since a bar graph such as shown in FIG. 1(*a*) can be displayed in two different colors, instead of only a single color, against an indistinct background color, so that the length of the bar compared to its maximum possible length is apparent to the viewer. Furthermore, the color attribute of each character does not need to be stored for each individual character; instead, a color attribute is stored only for each row of characters, thereby saving memory. The column and row addresses of the position where the bar should change from the first to the second color are stored in the row address register 33 and the bar position register 35, so that when such position is addressed, the characters fetched from the video RAM 51 and ROM 53 will be displayed in the remainder of the eighth row in the second color instead of the first color. Therefore, an enhanced bar display is achieved with the least memory requirements.

While the present invention has been particularly described with reference to FIGS. 1-3, it should be understood that the specific embodiments are for illustration only and should not be taken as limitations upon the invention. It is apparent that the method and apparatus of the present invention have utility in any display device desired, e.g. computer monitor displays. The invention also has utility in other raster type displays, including but not limited to LCD (Liquid Crystal Display), VFD (Vacuum Fluorescent Display), and plasma and gas discharge displays. It is contemplated that many changes and modifications may be made by one of ordinary skill in the art without limiting the scope of the invention as disclosed above.

What is claimed is:

1. A circuit for controlling the display of a two-color bar graph having a fixed starting position, a variable intermediate position, and a fixed ending position identified by row and column addresses defined on a color display screen driven by a raster scanning mechanism, comprising:

first comparator means for receiving a bar position signal corresponding to a column address identifying said variable intermediate position of said bar graph and a column address signal corresponding to a column address identifying a position which is being currently activated by said raster scanning mechanism on said color display screen, and generating an output in response thereof and a multiplexer having an output, a first input connected to a first color signal, a second input connected to a second color signal, and a select input connected to said first comparator output, wherein said select input causes said output to be equal to said first input when said select input is a first logic level and causes said output to be equal to said second input when said select input is a second logic level;

2. The circuit as recited in claim 1, wherein said raster scanning mechanism generates a horizontal synchronization signal, further comprising:

a pixel clock oscillator proportionally tuned to a scanning rate of said raster scanning mechanism; and a column address counter incremented by said pixel clock oscillator and reset by said horizontal synchronization signal;

wherein said column address signal is generated by said column address counter.

3. The circuit as recited in claim 1, further comprising:

second comparator means for receiving a first row address signal corresponding to a row address on said color display screen whereupon said two-color bar graph is to be displayed and a second row address signal corresponding to a row address identifying a row which is being currently activated by said raster scanning mechanism on said color display screen, and generating an output in response thereof which is equal to said first logic level if said second row address signal is less than or equal to said first row address signal, or said second logic level otherwise; and AND means for logically ANDing said outputs of said first and second comparator means, and generating a logic output in response thereof;

wherein said logic output is connected to said select input of said multiplexer instead of said first comparator output.

4. The circuit as recited in claim 3, further comprising a resettable flip-flop having an input connected to said logic output of said AND means, a clearing input connected to said horizontal sychronization signal, and an output, wherein said output of said resettable flip-flop is connected to said select input of said multiplexer instead of said logic output of said AND means.

* * * * *